United States Patent [19]

Crossfield et al.

[11] 4,098,703

[45] * Jul. 4, 1978

[54] YARN FINISH FORMULATIONS

[75] Inventors: Roger John Crossfield, Matthews; Norman Robert Cohen, Charlotte, both of N.C.

[73] Assignee: George A. Goulston Company, Inc., Monroe, N.C.

[ * ] Notice: The portion of the term of this patent subsequent to Aug. 31, 1993, has been disclaimed.

[21] Appl. No.: 692,076

[22] Filed: Jun. 2, 1976

Related U.S. Application Data

[63] Continuation-in-part of Ser. No. 397,338, Sep. 14, 1973, Pat. No. 3,977,979.

[51] Int. Cl.[2] ..... D06M 15/26; D06M 15/38

[52] U.S. Cl. ..... 252/8.6; 252/8.9

[58] Field of Search ..... 252/8.6, 8.9

[56] References Cited

U.S. PATENT DOCUMENTS

| | | | |
|---|---|---|---|
| 3,505,220 | 4/1970 | Blake et al. | 252/8.6 |
| 3,652,419 | 3/1972 | Karg | 252/8.8 |
| 3,997,450 | 12/1976 | Steinmiller | 252/8.7 |

*Primary Examiner*—John Kight, III

*Attorney, Agent, or Firm*—Sughrue, Rothwell, Mion, Zinn and Macpeak

[57] ABSTRACT

Yarn finishes, particularly of the coning oil type, containing a hydrocarbon soluble, long molecular chain polymeric viscosity index improver, such as polyisobutylene, are disclosed herein.

12 Claims, No Drawings

YARN FINISH FORMULATIONS

RELATIONSHIP TO OTHER APPLICATIONS

This application is a continuation-in-part application of Ser. No. 397,338, filed Sep. 14, 1973, now U.S. Pat. No. 3,977,979.

BACKGROUND OF THE INVENTION

The present invention relates to yarn finish formulations. More particularly, the present invention relates to yarn finishes applied to facilitate the processing of yarns, for example, the winding of yarns and the knitting and weaving of yarns into fabric. This invention has special reference to synthetic yarns, for example, polyester, nylon and acrylic yarns, and is described in its exemplifications with respect thereto.

Yarn finishes, which are usually multicomponent mixtures of ingredients carried in a liquid base, are applied to yarns for a number of reasons. Synthetic yarns without a finish surface coating usually cannot be processed at high speeds, are prone to break during processing, may develop static charges and often exhibit unwanted high friction levels across machinery guides and the like. Thus, a plethora of ingredients are routinely admixed and surface applied to the yarn. Antistatic agents, lubricants, emulsifiers, thickening agents, among others, are usually included in finish formulations. However, certain problems persist in the art to which the present application, as will be apparent hereinbelow, is directed.

In certain fiber processing applications, it has become highly desirable, if not necessary, to provide a finish formulation for coating yarn which is highly adherent while presenting a low friction surface on the yarn. Anti-static protection for the yarn, generally, is also needed.

In the area of yarn coning oils, particular problems are presented which are not satisfactorily dealt with by commercially available products. Coning oils are lubricants applied after yarn texturing to impart desirable properties to the yarn when subsequently handled during rewinding and by the yarn knitter or weaver. Typically, coning oils comprise blends of a base lubricant with a major proportion of an inert carrier liquid, most often mineral oil.

The base lubricant (generally a blend of two or more ingredients) used in coning oils, as well as in other yarn finishes containing lubricants, should have certain properties, namely (of course, the coning oil itself should also exhibit these properties):

(1) Lubricity: a lubricant is needed which reduces the coefficient of friction between fiber-to-metal surfaces in order to prevent fiber abrasion and maintain low, uniform tension during processing;

(2) Anti-static Control: a lubricant must have an anti-static property in order to dissipate static electric charges built up during processing;

(3) Cohesion: a balanced degree of choesion is essential since too much lubricity can cause fiber slippage resulting in package distortion in winding and other operations;

(4) Oxidation Resistance: after lubricants are applied, the fibers are often stored for prolonged periods of time; therefore, lubricants must be resistant to discoloration, bacterial growth, and formation of insoluble resinous compounds in the presence of oxygen;

(5) Scourability: since poor scourability can cause dyeing problems and potential soiling spots, lubricants must come off the yarn under mild scouring conditions and for this reason it is desirable to have a self-emulsifiable type of lubricant;

(6) Controlled Viscosity Range: too low a viscosity causes difficulties in slinging and low yarn frictional values while too high a viscosity causes excessive add-on coupled with high frictional values;

(7) Non-allergenic and Non-toxic: a lubricant must not cause any dermatological reaction since mill workers, especially at the throwster level, are constantly exposed to the neat oil, as well as finished cones of textured yarn;

(8) Odor-resistance: since yarn is often stored for relatively long periods of time, odor formation is undesirable and often intolerable;

(9) Product Stability: since mills store lubricants for long periods before use, product separation is extremely dangerous since it can go unnoticed until several thousand pounds of yarn have been treated;

(10) Corrosion Resistance: the yarn comes into contact with many metal surfaces during processing, and rusting tendencies would be detrimental to expensive machine parts; also, yarn pickup of rust deposits would cause dyeing problems;

(11) Non-volatility: product volatilization causes a percentage loss of lubricant on the yarn which results in serious knitting problems;

(12) Color: the lubricant should be water-white and non-yellowing during processing or storage of yarns, for example, at temperatures used during yarn and/or fabric stabilization and dyeing;

(13) Emulsifiable: non-uniform, unstable and difficult to emulsify lubricants perform poorly in coning oil applications, for example in causing variable effects during winding, scouring, dyeing and the like; and

(14) Adherency: the coning oil must not be thrown off of the yarn during high speed winding operations (termed "low slinging" in the art). This problem of "sling off" is exaggerated at points along the winding path where the yarn changes direction, for example at traverse.

Of the above listing of desirable coning oil properties, providing a finish of controlled viscosity range in relationship to low slinging propensity at acceptable frictional values has presented a perplexing problem to the industry. For example, increasing viscosity through addition of high viscosity mineral oils or heavy metal soap gelling agents, such as aluminum stearate, deleteriously affects friction level and does not provide an oil of acceptable viscosity index characteristics. Viscosity index refers to thinning (lowering of viscosity) under high temperature or high frictional shear conditions.

Another area presenting particularly sensitive problems regarding adherence and friction level is that of needle oils used during knitting operations. Needle oils are conventionally applied as a spray to a plurality of steel knitting needles with the objective of lubricating the needles during the knitting operation. Obviously, a highly viscous lubricant characterized by high film strength and excellent adherence to the knitting needles is needed, along with superior frictional wear protection properties and at least adequate anti-static protection to reduce charge buildup around the knitting machine. Another prime requirement is resistance to fogging during spraying. Thus, if the finish does not essentially remain on the needles in the form of a continuous lubricating film, poor lubrication and needle wear will result. Further, finish will accumulate on and around other machinery parts, presenting hazardous working conditions and difficult clean-up tasks. Obviously, some needle oil will accumulate on the knitted fabric during processing so as an additional requirement, the finish must be able to be washed from the fabric during the customary scouring and/or finishing operation to which fabrics are subjected. In essence, this means water washability. As stated above with respect to coning oils, a good viscosity index is needed to prevent thinning out of the needle oil when contacted by the hot, moving knitting needles.

In order to formulate coning oils, needle lubricants and similar finishes of high film strength and fiber adherence, as well as acceptable viscosity index characteristics, it has been thought that one need only use thicker fluid solvents, perhaps in conjunction with boundary lubricants. White oil has become the accepted coning and needle oil finish base, often providing 80 percent or more by weight of the finish formulation. However, it has been found that when one employs higher viscosity white oils to thicken a coning oil, other factors remaining constant, yarn-to-metal friction increases to unacceptable values at the high yarn speeds used today in the fabric formation and yarn winding arts. Also in the case of needle oils, the high viscosity oils thin out appreciably on heating and then lose their film strength and lubricating efficiency. As stated above, the use of heavy metal soap gelling agents does not satisfactorily solve these problems.

SUMMARY OF THE INVENTION

It has now been found that the addition of a small amount by weight of a hydrocarbon soluble, long molecular chain polymeric viscosity index improver to an otherwise conventional finish formulation, the polymeric material being soluble and/or dispersible in the finish formulation, markedly increases the viscosity of the formulation without altering the anti-friction attributes of the finish, even during high speed yarn processing. Additionally, it is believed that the polymeric material aids in increasing the film strength of the finish formulation, which in turn results in better adherence to the fiber substrate, less propensity for dripping, less finish "throw-off" during high speed winding and the like properties.

In preferred embodiments of the invention, the viscosity index improver is a polymethacrylate, a polyalkylstyrene, an ethylene-propylene copolymer or a polyisobutylene.

In the most preferred embodiments of the invention, the polymeric material is polyisobutylene essentially having only terminal unsaturation and a viscosity average molecular weight (Flory) of about 20,000 to 100,000.

In another preferred embodiment of the invention, the polyisobutylene is used in about 0.1 to 15 percent, preferably 0.75 to 10.0 percent by weight in an oil formulation formed of lubricant, anti-static agent, and emulsifiers in a white oil vehicle. Where desired the improved oil can be prepared in concentrate form with up to about 35 percent or more of the polymeric viscosity index improver dispersed in mineral oil or other hydrocarbon vehicle which is later diluted with an additional amount of vehicle to form a usable coning, knitting or other yarn finish formulation.

In still another preferred embodiment of the invention, the polyisobutylene is used in a mineral oil base coning oil finish to facilitate the high speed winding of yarn onto conical packages under good friction conditions with minimal "throw-off" of finish from the yarn during the high speed winding process.

In other embodiments of the invention, the polyisobutylene is used in needle oil finishes.

Another embodiment of the invention resides in a yarn carrying a finish formulation including a hydrocarbon soluble long molecular chain polymeric viscosity index improver, preferably polyisobutylene.

DETAILED DESCRIPTION OF THE INVENTION

The present invention relates to improved yarn finishes, particularly of the type to be applied to synthetic fiber yarns. By "synthetic fiber yarns" as used herein is meant yarns or fibers which are not naturally occurring in fiber form. In other words, synthetic fibers are formed by an extrusion process regardless of whether the material forming the fiber is basically naturally-occurring (e.g., cellulose acetate) or purely synthetic (e.g., polyester and nylon fibers). This is not to say that the natural fibers in the form of spun yarns or tows may not at times be able to enjoy the benefits of the present invention; however, at this time the invention's greatest utility appears to lie in the synthetic fiber area, particularly as applied to polyester, nylon and acrylic fibers. The terms "polyester", "nylon" and "acrylic" are used herein to be inclusive of all polymeric-type fibers which the artisan considers to be generally designated thereby and mixtures thereof.

As stated hereinabove, it is frequently desirable to increase the viscosity of certain types of yarn finishes, e.g., coning oils and knitting needle oils while maintaining an acceptable viscosity index, film strength and frictional properties. This type of finish is sub-generally classified as an "oil" because it is essentially non-aqueous, although at times up to about 10 to 15 percent water may be present (All percentages unless otherwise indicated are weight to weight herein). The most widely used vehicle or base for such finish oils is mineral oil, or a purified product thereof such as white oil. Therefore, the present invention is exemplified using a white oil base, although those skilled in the art will appreciate that other hydrocarbon vehicles, or even long chain synthetic esters, used as the predominant solvent carrier for non-aqueous finish formulations may be substituted for all or part of the white oil. For example, one may employ as part or all of the solvent medium straight chain esters such as hexadecyl stearate, neo esters such as trimethylpelargonate glycerol esters of long chain fatty acids, e.g., the esters of coconut oil and corn oil, and mixtures thereof. Also, finishes for other purposes, such as spun yarn finishes, may usefully enjoy the benefits of the invention where suitable.

White oil, unlike many of the solvents used as bases for finish oils, is available in a variety of viscosities. The most common viscosity grades employed in finish formulations are in about the 50 to 200 second range (Saybolt universal seconds at 100° F. is the viscosity measurement designation used throughout this specification), or at least blends of various viscosity grade oils are used to produce a vehicle having an average viscosity in the aforementioned range.

Generally, it is desirable to work with finishes in the lower portion of the above viscosity range. Particularly with white oils, it has been found that once the viscosity of the oil reaches about 115 seconds or above, the oil appears to increase the fiber-to-metal friction of the yarn to which it has been applied. In other words, as soon as it becomes apparent that a higher viscosity finish system is desirable for certain purposes the obvious solution is to employ a higher viscosity white oil. Surprisingly, this solution is not fully satisfactory because of the deleterious effect on the fiber-to-metal frictional characteristics of the finish. Of course, special additives to reduce friction, other than lubricants which may already be present in the formulation, may be considered to overcome this problem, but present the additional consideration of interaction with other finish formulation components, cost, handling ease and the like. Ideally, a viscosity improvement agent, inert regarding other finish properties, particularly frictional characteristics, would be the solution, and it is in this direction that the present invention proceeds.

The present applicant has found that long molecular chain polymeric viscosity index improvers, in small amounts, can be dispersed in finish oils to markedly increase their viscosity without adversely affecting other desired finish properties, particularly fiber-to-metal friction, of yarns carrying the long molecular chain polymeric viscosity index improver-containing finish.

The long chain polymeric viscosity improvers are known in the motor oil art. Generally, they are either polymethacrylates, polyalkylstyrenes or polyisobutylenes, although other polymeric types may be known such as ethylene-propylene copolymers. These materials, essentially inert, have been found to be usable in yarn finishes, particularly mineral oil based, to increase viscosity, improve viscosity index, contribute to a low friction index and prevent "sling off" of finish from the yarn during high speed processing.

Because polyisobutylene is the recommended polymeric viscosity improver at this time, the invention will be described in greater detail and exemplified therewith. However, it should be noted that the polyalkylstyrenes (one to ten carbon straight or branch chain alkyl group) and polymethacrylates will possess the same general characteristic regarding the physical and chemical properties, for example solubility, as described for the polyisobutylenes.

The molecular weight range of the polyalkylstyrene, polymethacrylate or of the ethylene-propylene copolymer will be within the range of 300,000 – 800,000, preferably 550,000 – 750,000 (Flory).

Polyisobutylene is a highly paraffinic hydrocarbon polymer composed of long straight chain molecules. Unless modified in some manner, the polyisobutylene molecules have terminal unsaturation only, and because of this molecular structure, are relatively inert. Polyisobutylene, with agitation and heat necessary, is soluble in most hydrocarbon solvents. It is believed that the long polyisobutylene molecular chains may be aligned somewhat haphazardly at room temperature, but become straight, extended chains at even elevated temperatures and remain as such throughout all temperature ranges used in fiber processing operations. As the chain straightens out at elevated temperatures it tends to balance the viscosity decrease due to thinning of the oil. Thus, as yarns or needles become hot during processing there is less throwing or slinging off of finish. This molecular thermal stability contributes to a viscosity less dependent of temperature (lower viscosity index) once a given theshold temperature is reached. Further, the very long polymer chains are believed to contribute to the low friction level of the ultimate finish blend.

Although essentially 100 percent polyisobutylene polymer is preferred, the viscosity improvement additive may contain a second monomer copolymerizable with isobutylene. Any comonomer may be employed as long as it does not interfere with the viscosity improvement properties and inert character of the polyisobutylenes. For example, the polymer may contain up to about 3 percent isoprene.

The polyisobutylene may be of nearly any commercially available molecular weight. However, for ease of solubility in the hydrocarbon solvents, the semi-solid polyisobutylenes are preferred and the percentages of additive disclosed herein are for such materials. The semi-solid polyisobutylenes have a viscosity average molecular weight (Staudinger) up to about 12,000, preferably about 7,500 to 12,000. Such materials are clear, viscous, tacky, gel-like materials. Higher molecular weight rubbery solid polyisobutylenes, up to about 150,000 viscosity average molecular weight (Staudinger), preferably 60,000 to 90,000 or over 2,000,000 (Flory), can be employed, generally with a lowering of concentration required for equivalent viscosity improvement effect.

The polyisobutylene is present in the formulation in about 0.1 to 15, preferably 0.75 to 10.0 percent, most preferably about 1.0 to 5.0 percent. Starting with an 80-second white oil base, the preferred range of addition results in about a 95- to 290-second viscosity range of solvent. As disclosed hereinabove, concentrates of 10 to 40 percent solids can be employed.

Although not entirely necessary, from the practical standpoint of time, it becomes necessary to employ heat with agitation to dissolve the polyisobutylene in the hydrocarbon solvent. For example, about up to 10 percent polyisobutylene can be dissolved within a few minutes in white oil heated to about 90° to 100° C. with vigorous agitation. If the higher molecular weight polyisobutylenes are used, solvation ordinarily takes several hours. Very slowly, the solid polyisobutylenes imbibe solvent and swell until finally becoming semi-liquid to which additional solvent can be rapidly added.

Anti-static agents, emulsifiers, lubricants other than the hydrocarbon vehicle and other finish formulation components are employed in the preparation of the multicomponent finishes in the same manner and are found therein for the same purposes as before the present invention.

Often, it has been found desirable to employ a boundary lubricant in the finish to aid the polyisobutylene in increasing the finish film strength (and to improve wearing of metal parts such as knitting needles) of the finish on the yarn. Suitable boundary lubricant additives are those employed by the artisan and compatible with other finish components, for example the substituted and unsubstituted triaryl phosphates or alkyl phosphites, particularly the triphenyl and tricresyl phosphates. Other suitable boundary lubricants are the trialkyl phosphites such as tricrescyl phosphite and synthetic esters such as butyl stearate and isopropyl palmitate.

The following experiments were carried out to illustrate the increase in viscosity obtained by blends of white oil and polyisobutylene and the effect of such formulations on the fiber-to-metal friction values of flat (untextured) 140 denier polyester (polyethylene terephthalate) yarn carrying 1 percent finish addition based on yarn weight. The polyisobutylene used in these experiments, as in all other examples herein, was Vistanex® polyisobutylene grade LM-MS (8,700 to 10,000 viscosity average molecular weight according to Staudinger or 35,000 viscosity average molecular weight according to Flory), available from the Enjay Chemical Company. The artisan is respectfully referred to publications available from the Enjay Chemical Company describing the Vistanex® polyisobutylenes.

Friction is measured at the yarn speeds indicated in the following tables under the following test conditions. Frictions were measured using the Rothschild friction tester at 72° F., 60 percent relative humidity. 140/36 polyester yarn was passed over a 4RMS surface bright chrome pin at a pretension of 15 grams ($T_1$) and wrap angle of 180° F. Average post-pin tension ($T_2$) was noted for each speed over a 3-minute period.

Frictional drag of the yarn over the pin ($T_F$) is expressed as the difference between the post-pin and pre-pin tensions ($T_F = T_2 - T_1$).

TABLE I

| Friction ($T_F$) (grams) | YARN SPEED (Meters per minute) 50 | 100 | 200 | 300 |
|---|---|---|---|---|
| friction of Oil A | 55 | 72 | 85 | 84 |
| friction of Oil B | 78 | 95 | 107 | 107 |
| friction of Oil C | 56 | 73 | 88 | 89 |
| friction of Oil D | 92 | 106 | 117 | 115 |

Oil A is an 80-second white oil to which there has been added 3 percent of the polyisobutylene. This oil has a viscosity of 152 seconds.

Oil B is a 149-second white oil.

Oil C is an 80-second white oil to which there has been added 4.5 percent of the polyisobutylene. This oil has a viscosity of 208 seconds.

Oil D is a 198-second white oil.

Table I demonstrates the lower friction value of yarn coated with polyisobutylene-containing finish as compared to about the same viscosity white oil and, secondly, the stabilization of friction level over a viscosity range when polyisobutylene is employed as compared to white oil.

The following experiment, detailed in Table II, was carried out on false twist textured polyester (polyethylene terephthalate) yarn to illustrate increasing the viscosity of a commercial white oil based coning oil with polyisobutylene to lower finish "throw-off" during coning without affecting yarn friction. The friction test is the same as described hereinabove with respect to Table I.

TABLE II

| Friction ($T_F$) (grams) | YARN SPEED (Meters per minute) 100 | 200 | 300 |
|---|---|---|---|
| friction of Oil E | 32 | 33.5 | 35.75 |
| friction of Oil F | 32.5 | 34.25 | 36.25 |
| friction of Oil G | 32.75 | 34.75 | 36.25 |

Oil E is an 80-second commercially available white oil based coning oil.

Oil F is oil E to which 2.6 percent of the polyisobutylene has been added to increase its viscosity to 140 seconds.

Oil G is oil E to which 3.4 percent of the polyisobutylene has been added to increase its viscosity to 180 seconds.

Throw-off using oils E, F and G was rated subjectively under standard winding conditions on a Schweiter model KEK-PN Precision Winder (550 yards/minute) winding speed, and it was estimated that oils F and G shows about 60;14 70 percent reduction in oil spraying over the machine and on the surrounding floor.

EXAMPLE I

The formulation of this Example is a coning oil to be applied to yarn as it is being wound at high speed.

One particular use of the oil of this Example is in the high speed winding and coning of textured yarn, which is usually performed after package dyeing. In these operations, yarn is wound generally at high speed, up to 1,000 yards/minute, from a package dye tube to a conventional cone for sale purposes. The coning lubricant can be applied either via a kiss roll and trough or via a metering device. Due to the high speed and vibrations and centrifugal force, conventional coning oils with viscosities of around 50 to 100 seconds are thrown off as the yarn changes direction, for example at traverse. This results in oil or lubricant deposited over machine parts, but more importantly over the floors surrounding the machine which causes hazardous working conditions and difficult cleanup tasks. The coning oil of this example has a viscosity of about 130 to 135 seconds, provides excellent frictional properties to the yarn and, most important, is essentially not thrown off of the yarn during winding.

The coning formulation is:

| | |
|---|---|
| 80 second Mineral Oil | 82.5 |
| POE (3) dodecyl alcohol | 12.0 |
| POE (3) tridecyl phosphate-potassium salt | 2.5 |
| Vistanex® polyisobutylene grade LM-MS | 2.5 |
| Water | 0.5 |
| | 100.0 |

This coning oil can be applied by any convenient means to the yarn in an amount of about 0.5 to 6.0 percent based on the weight of the yarn, preferably about 3.0 to 5.0 percent.

EXAMPLE II

The formulation of this Example is another coning oil finish used in the same manner as the finish of Example 1.

| | |
|---|---|
| 70 second Mineral Oil | 81.4 |
| Polyethylene Glycol 100 Monooleate | 15.0 |
| 45% KOH (Potassium Hydroxide) | 2.0 |
| Vistanex® polyisobutylene grade LM-MS | 1.6 |
| | 100.0 |

This oil has a viscosity of 130 to 135 seconds.

EXAMPLE III

This Example illustrates a knitting needle oil which can be sprayed as a fine mist onto the knitting needles of a circular knitting machine. The formulation has a viscosity of 250 seconds without sacrificing frictional properties. The finish has excellent film strength and adherence to the needles and prevents needle wear. These improved properties are believed due to the presence of a boundary lubricant and the polyisobutylene. The finish is essentially drip-free. Sufficient emulsifiers are included in the formulation so that the finish can be washed off of the fabric during aqueous scouring and/or other finishing sequences. The finish formulation is as follows:

| | |
|---|---|
| Vistanex$^R$ polyisobutylene grade LM-MS | 1.5 |
| 350 second white oil | 57.0 |
| 80 second shite oil | 32.5 |
| Tricresyl phosphate | 1.0 |
| Dantoest DO | 2.0 |
| POE (2) nonyl phenol | 2.0 |
| POE (4) nonyl phenol | 1.0 |
| POE (4) lauryl alcohol | 2.0 |
| POE (3) potassium salt of tridecyl phosphate | 1.0 |
| | 100.0 |

Dantoest DO, available from the Glyco Chemical Company, is chemically dimethyl dihydroxy hydantoin dioleate and functions in the formulation as a lubricant and anti-static agent. The tricresyl phosphate is present as a boundary lubricant. The phosphate salt is an anti-static agent. POE in all of the Examples stands for polyoxyethylene with the materials containing the number of polyoxyethylene units indicated in parentheses per molecule. The polyoxyethylated materials are emulsifiers to facilitate washing off of the finish during scouring. Other antistatic agents and emulsifiers can be substituted for those set forth in the above formulation. However, substituted hydantoins and ethoxylated (2 to 9 ethylene oxide groups per molecular) $C_6$ to $C_{18}$ phosphate esters are preferred anti-static agents while alkoxylated natural or synthetic alcohols ($C_{10}$ – $C_{18}$) (1 to 15 moles alkylene oxide, preferably ethylene oxide), or the alkoxylated alkyl phenols (1 to 15 moles alkylene oxide, preferably ethylene oxide), or the alkoxylated, preferably ethoxylated, fatty acids ($C_8$ – $C_{18}$), or fatty glycerides or glycol esters of fatty acids ($C_8$ – $C_{18}$) are preferred emulsifiers. Preferably the former is used in coning oils due to its lighter color. The glycol esters may be polyethylene glycol esters of $C_8$ – $C_{18}$ fatty acids. The alkoxylated alkyl phenols are often monoalkyl phenols substituted with $C_3$ to $C_{18}$ straight or branched chain alkyl groups.

EXAMPLE IV

The formulation of this Example is another needle oil, having a viscosity of 140 seconds.

| | |
|---|---|
| 30-second white oil | 90.2 |

-continued

| | |
|---|---|
| Vistanex$^R$ polyisobutylene grade LM-MS | 1.8 |
| Tri (decyl) phosphite | 1.0 |
| POE (4) dodecyl alcohol | 6.0 |
| POE (3) hexyl phosphate-potassium salt | 1.0 |
| | 100.0 |

Modifications of this invention will be apparent to those skilled in the art.

What is claimed as new and desired to be secured by Letters Patent of the United States is:

1. A yarn finish consisting essentially of a major amount of mineral oil, a minor, viscosity improvement amount of 0.1 to 15 percent by weight based on weight of the finish of a hydrocarbon soluble, long molecular chain polymeric viscosity index improver selected from the group consisting of polyisobutylene having an average viscosity molecular weight of about 7500 to 150,000 (Staudinger), polyalkylstyrene having a molecular weight of about 300,000 to 800,000 (Flory), polymethacrylate having a molecular weight of about 300,000 to 800,000 (Flory), and ethylene-propylene copolymer having a molecular weight of about 300,000 to 800,000 (Fory), and a minor amount of a compatible emulsifier.

2. The yarn finish of claim 1, wherein the index improver is polyisobutylene.

3. The yarn finish of claim 1, wherein the emulsifier is selected from the group consisting of alkoxylated natural or synthetic alcohols, alkoxylated alkyl phenols, alkoxylated fatty acids, fatty glycerides or glycol esters of fatty acids.

4. The yarn finish of claim 1, also including a boundary lubricant.

5. The yarn finish of claim 1, also including an anti-static agent.

6. The yarn finish of claim 1, wherein the index improver is a polyalkylstyrene.

7. The yarn finish of claim 1, wherein the index improver is a polymethacrylate.

8. The yarn finish of claim 1, wherein the index improver is an ethylene-propylene copolymer.

9. The yarn finish of claim 2, wherein the polyisobutylene is present in about 0.75 – 10.0 percent.

10. The yarn finish of claim 2, wherein the polyisobutylene is present in about 1.0 to 5.0 percent.

11. A yarn carrying the yarn finish of claim 1.

12. A yarn finish characterized by reduced slinging propensity, controlled viscosity and good frictional characteristics consisting essentially of a major amount of mineral oil, a minor, viscosity improvement amount of a hydrocarbon soluble, long molecular chain polymeric viscosity index improver selected from the group consisting of polyisobutylene having an average viscosity molecular weight of about 7500 to 150,000 (Staudinger), polyalkylstyrene having a molecular weight of about 300,000 to 800,000 (Flory), polymethacrylate having a molecular weight of about 300,000 to 800,000 (Flory), and ethylene-propylene copolymer having a molecular weight of about 300,000 to 800,000 (Flory), and a minor amount of a compatible emulsifier.

* * * * *